US008282697B2

(12) United States Patent
Oh

(10) Patent No.: US 8,282,697 B2
(45) Date of Patent: Oct. 9, 2012

(54) DUST COLLECTING APPARATUS FOR VACUUM CLEANER

(75) Inventor: Jang-Keun Oh, Gwangju (KR)

(73) Assignee: Samsung Electronics Co., Ltd., Gwangju-si (KR)

( * ) Notice: Subject to any disclaimer, the term of this patent is extended or adjusted under 35 U.S.C. 154(b) by 227 days.

(21) Appl. No.: 12/690,393

(22) Filed: Jan. 20, 2010

(65) Prior Publication Data

US 2010/0205915 A1 Aug. 19, 2010

Related U.S. Application Data

(60) Provisional application No. 61/152,843, filed on Feb. 16, 2009.

(30) Foreign Application Priority Data

Mar. 11, 2009 (KR) ..... 10-2009-0020747

(51) Int. Cl.
*B01D 45/14* (2006.01)

(52) U.S. Cl. ..... 55/345; 55/DIG. 3; 55/429; 15/353; 15/352

(58) Field of Classification Search ..... 55/DIG. 2, 55/DIG. 3, DIG. 8, 366, 395, 429
See application file for complete search history.

(56) References Cited

U.S. PATENT DOCUMENTS 6,502,278 B2 * 1/2003 Oh et al. ..... 15/353
6,840,972 B1 * 1/2005 Kim ..... 55/337
6,902,596 B2 * 6/2005 Conrad et al. ..... 55/459.1
7,326,268 B2 * 2/2008 Oh et al. ..... 55/343
2003/0200622 A1 * 10/2003 Park et al. ..... 15/353
2003/0221278 A1 * 12/2003 Oh ..... 15/352
2003/0221279 A1 * 12/2003 Oh et al. ..... 15/353
2004/0103495 A1 * 6/2004 Oh ..... 15/352
2005/0252179 A1 * 11/2005 Oh et al. ..... 55/337
2006/0230722 A1 * 10/2006 Oh et al. ..... 55/345

FOREIGN PATENT DOCUMENTS

KR 100776403 11/2007
KR 1020080066291 7/2008
KR 1020080093607 10/2008

* cited by examiner

*Primary Examiner* — Duane Smith
*Assistant Examiner* — Sonji Turner
(74) *Attorney, Agent, or Firm* — Ohlandt, Greeley, Ruggiero & Perle, LLP

(57) ABSTRACT

A dust collecting apparatus for a vacuum cleaner is provided. The dust collecting apparatus includes a dust separating chamber separating dust from dust-laden air, a dust collecting chamber storing the dust separated by the dust separating chamber, and an air discharge guide duct guiding the air discharged from the dust separating chamber to an air outlet at a lower end of the dust collecting chamber. The air discharge guide duct includes a first duct formed on a rear surface of the dust collecting apparatus so as to guide the air discharged from the dust separating chamber downwards, a second duct being coupled with the first duct and extending into the dust separating chamber, and a third duct formed in the dust separating chamber so as to connect the second duct with the air outlet.

12 Claims, 5 Drawing Sheets

DUST COLLECTING APPARATUS FOR VACUUM CLEANER

CROSS-REFERENCE TO RELATED APPLICATIONS

This application claims the benefit under 35 U.S.C. §119 (a) of U.S. Provisional Application No. 61/152,843, filed in the USPTO on Feb. 16, 2009, and under 35 U.S.C. §119 of Korean Patent Application No. 10-2009-0020747, filed in the Korean Intellectual Property Office on Mar. 11, 2009, the entire disclosures of both of which are incorporated herein by reference.

BACKGROUND OF THE INVENTION

1. Field of the Invention

The present disclosure relates to a dust collecting apparatus for a vacuum cleaner, and more particularly to a dust collecting apparatus for a vacuum cleaner that is integrally formed with an air discharge guide duct that is coupled with a suction motor.

2. Description of the Related Art

Vacuum cleaners draw in dust-laden air from surface being cleaned and remove dust from the air. Vacuum cleaners are generally divided into canister vacuum cleaners, in which a suction nozzle (suction brush) is connected to a cleaner body through an extension pipe, and upright vacuum cleaners, in which a suction nozzle is connected directly to a cleaner body.

Recently, a cyclone dust collecting apparatus that separates dust from drawn-in air by rotating the air has been widespread due to its advantages of having no necessity of replacing a dust bag and using it semi-permanently.

In general, a cyclone dust collecting apparatus is disposed in front of a suction motor of a canister vacuum cleaner or disposed on the upper side of a suction motor of an upright vacuum cleaner. An air discharge guide means such as a discharge duct is usually disposed between a cyclone dust collecting apparatus and a suction motor so as to guide air discharged from the cyclone dust collecting apparatus to the suction motor.

Such an air discharge guide means may be integrally formed with a cyclone dust collecting apparatus or be formed at a cleaner body. If the air discharge guide means is integrally formed with a cyclone dust collecting apparatus, dust collecting space of the cyclone dust collecting apparatus may be encroached by the air discharge guide means. If the air discharge guide means is formed in a cleaner body, the volume of cleaner body may increase.

SUMMARY OF THE INVENTION

An aspect of embodiments of the present disclosure is to solve at least the above problems and/or disadvantages and to provide at least the advantages described below. Accordingly, an aspect of embodiments of the present disclosure is to provide a dust collecting apparatus for a vacuum cleaner that may reduce invasion of dust collecting space by an air discharge guide means and may less require space for installing the air discharge guide means when the air discharge guide means is integrally formed with the dust collecting apparatus.

In order to achieve the above-described and other aspects of embodiments of the present disclosure, a dust collecting apparatus for a vacuum cleaner that has an air outlet at a lower end of the dust collecting apparatus and discharges cleaned air to a suction motor through the air outlet is provided including a dust separating chamber separating dust from dust-laden air, a dust collecting chamber storing the dust separated by the dust separating chamber, and an air discharge guide duct guiding the air discharged from the dust separating chamber to the air outlet, wherein the air discharge guide duct includes a first duct formed on a rear surface of the dust collecting apparatus so as to guide the air discharged from the dust separating chamber downwards, a second duct being coupled with the first duct and extending into the dust separating chamber, and a third duct formed in the dust separating chamber so as to connect the second duct with the air outlet.

The dust separating chamber may include a primary dust separating chamber and at least one secondary dust separating chamber.

The primary dust separating chamber may be disposed in the dust collecting chamber, and a lower surface of the primary dust separating chamber may be disposed higher than a lower surface of the dust collecting chamber.

A grill member may be provided in the primary dust separating chamber and another grill member may be provided in the secondary dust separating chamber.

An air inlet may be formed on the rear surface of the dust collecting apparatus.

One end of the air inlet may be inclined.

There may be a plurality of secondary dust separating chambers that are arranged in parallel.

The dust collecting chamber and the primary dust separating chamber may be separated from or coupled with the secondary dust separating chambers.

A lower cover of the dust collecting chamber may be opened or closed.

A handle may be disposed on the secondary dust separating chamber, and may have a hook member to be locked with a cleaner body.

The primary dust separating chamber and the secondary dust separating chamber may be cyclone separating chambers, and an air spinning axis of the primary dust separating chamber and an air spinning axis of the secondary dust separating chamber may cross each other.

In order to achieve the above-described and other aspects of embodiments of the present disclosure, a dust collecting apparatus for a vacuum cleaner that has an air outlet at a lower end of the dust collecting apparatus and discharges cleaned air to a suction motor through the air outlet is provided including a dust collecting unit having an opened upper portion, a primary dust separating unit formed in the dust collecting unit, a connection unit disposed to shut the upper portion of the dust collecting unit airtight, a secondary dust separating unit coupled with an upper portion of the connection unit, and an air discharge guide duct guiding the cleaned air discharged from the secondary dust separating unit to the air outlet, wherein the air discharge guide duct comprises a first duct formed on a rear surface of the dust collecting unit along a longitudinal direction of the dust collecting unit.

The dust collecting unit may include a first dust collecting chamber and a second dust collecting chamber.

The air discharge guide duct may further include a second duct penetrating the second dust collecting chamber and extending into the first dust collecting chamber, and a third duct extending to a bottom of the dust separating unit.

The dust collecting unit and the primary dust separating unit may be separable from the connection unit.

The primary dust separating unit may be spaced apart from a bottom of the dust collecting unit at a predetermined distance.

In order to achieve the above-described and other aspects of embodiments of the present disclosure, a dust collecting apparatus for a vacuum cleaner that has an air outlet at a lower end of the dust collecting apparatus and discharges cleaned air to a suction motor through the air outlet is provided including a dust collecting unit having an opened upper portion, a primary dust separating unit formed in the dust collecting unit, a connection unit disposed to shut the upper portion of the dust collecting unit airtight, a secondary dust separating unit coupled with an upper portion of the connection unit, and an air discharge guide duct guiding the cleaned air discharged from the secondary dust separating unit to the air outlet, wherein the air discharge guide duct comprises a second duct extending into the dust collecting unit.

The air discharge guide duct may further include a first duct formed on a rear surface of the dust collecting apparatus and being connected to a first end of the second duct, and a third duct formed in the dust collecting unit and being connected to a second end of the second duct.

As can be appreciated from the above description of the dust collecting apparatus, the cleaned air is discharged to the suction motor through the lower end of the dust collecting apparatus, so an air path between the dust collecting apparatus and the suction motor can be shortened, thereby reducing the loss by the air path.

In addition, since the first duct of the air discharge guide duct is formed at the external surface of the dust collecting apparatus, invasion of dust collecting space by the air discharge guide duct may be reduced.

In addition, since the air discharge guide duct is integrally formed with the dust collecting apparatus, the cleaner body in which the dust collecting apparatus is installed does not need to have a separate component for guiding cleaned air to the suction motor. Accordingly, the structure of the cleaner body may be more simplified.

Since the lower cover capable of being opened or closed is installed at the lower end of the dust collecting apparatus, the user may easily dump the dust collected in the dust collecting chambers.

Furthermore, the dust collecting unit, the primary dust separating unit, the connection unit, the secondary dust separating unit, and the duct forming member can be separated from each other, so it is easy to disassemble and repair the dust collecting apparatus if necessary.

Lastly, one end of the air inlet of the dust collecting apparatus is inclined, so when the dust collecting apparatus is mounted on the cleaner body, airtight connection between the air inlet of the dust collecting apparatus and the connection port of the cleaner body can be guaranteed and the sealing member can be prevented from being abnormally pushed by the air inlet.

BRIEF DESCRIPTION OF THE DRAWINGS

These and/or other aspects and advantages of the invention will become apparent and more readily appreciated from the following description and the accompanying drawings of which:

FIGS. 5 and 6 illustrate a connection between an air inlet of the dust collecting apparatus for the vacuum cleaner of FIG. 1 and a connection port of a cleaner body, in which FIG. 5 illustrates the air inlet before being connected to the connection port and FIG. 6 illustrates the air inlet connected to the connection port.

DETAILED DESCRIPTION OF THE PRESENT DISCLOSURE

Figure 1:
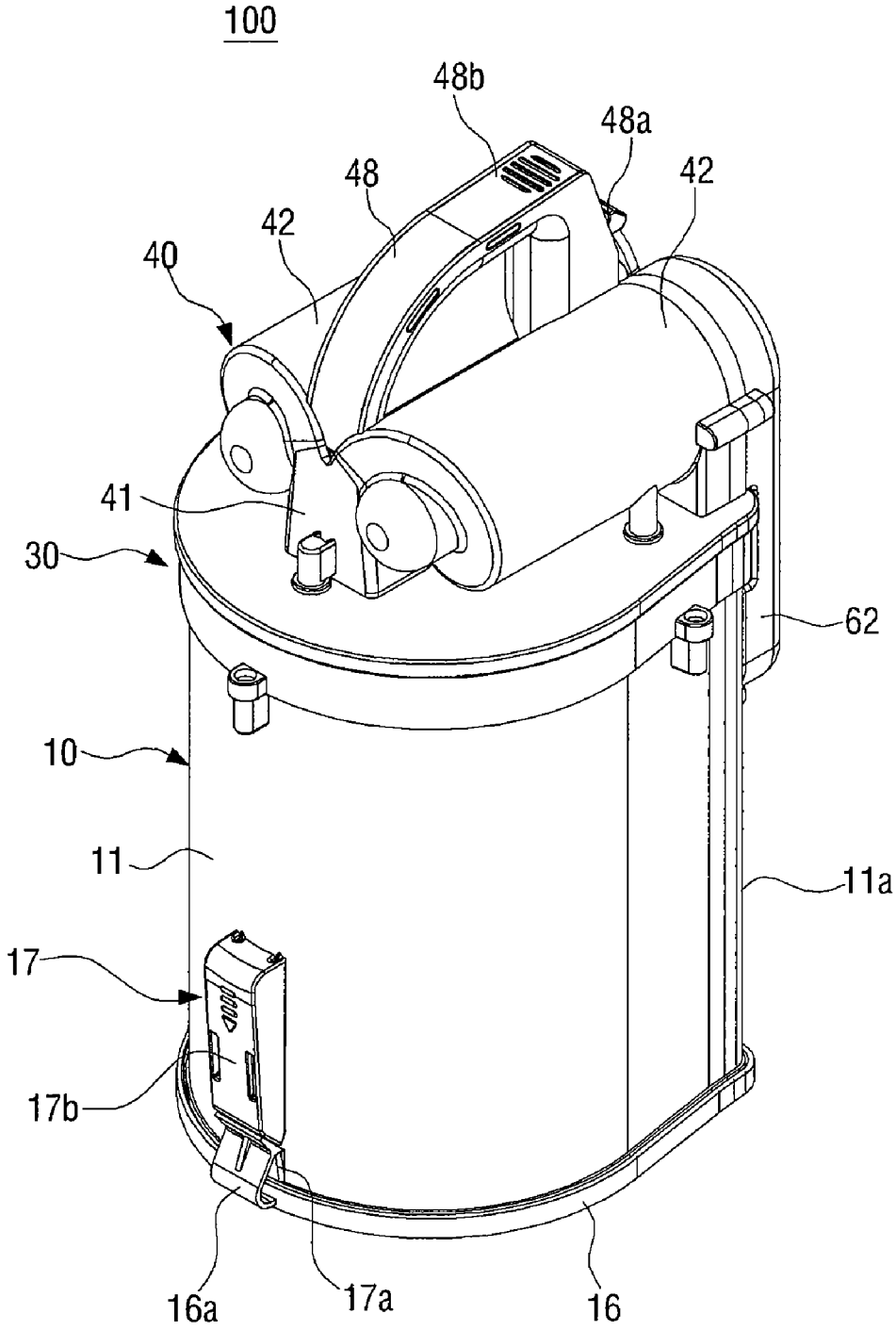
FIG. 1 is a front perspective view illustrating a dust collecting apparatus for a vacuum cleaner according to an exemplary embodiment of the present disclosure.

Reference will now be made to the accompanying drawings, wherein like reference numerals refer to like elements throughout. The embodiments are described below in order to explain the present disclosure by referring to the figures.

Figure 2:
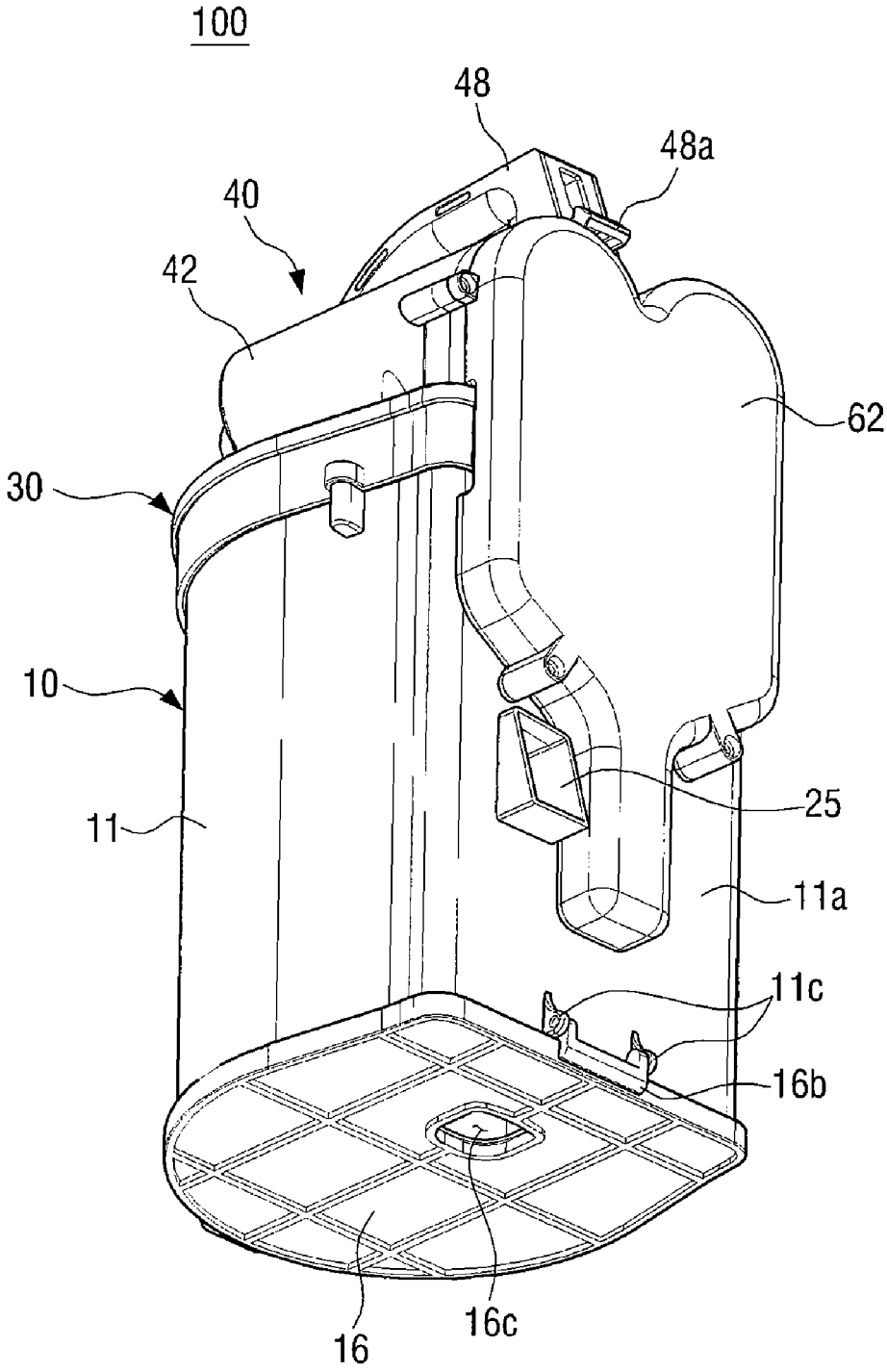
FIG. 2 is a rear perspective view illustrating the dust collecting apparatus for the vacuum cleaner of FIG. 1.
Figure 3:
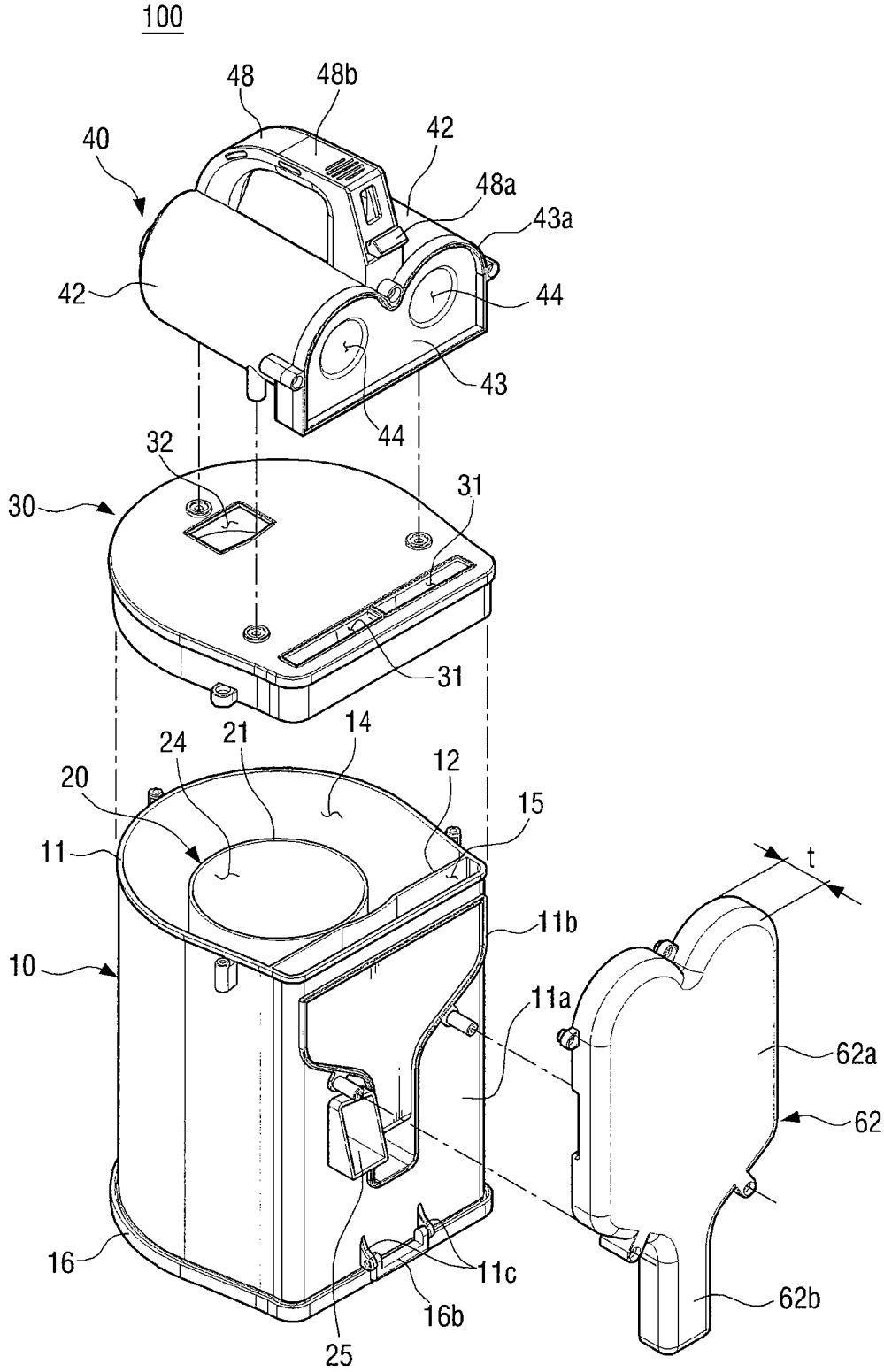
FIG. 3 is a partially exploded view illustrating the dust collecting apparatus for the vacuum cleaner of FIG. 1.
Figure 4:
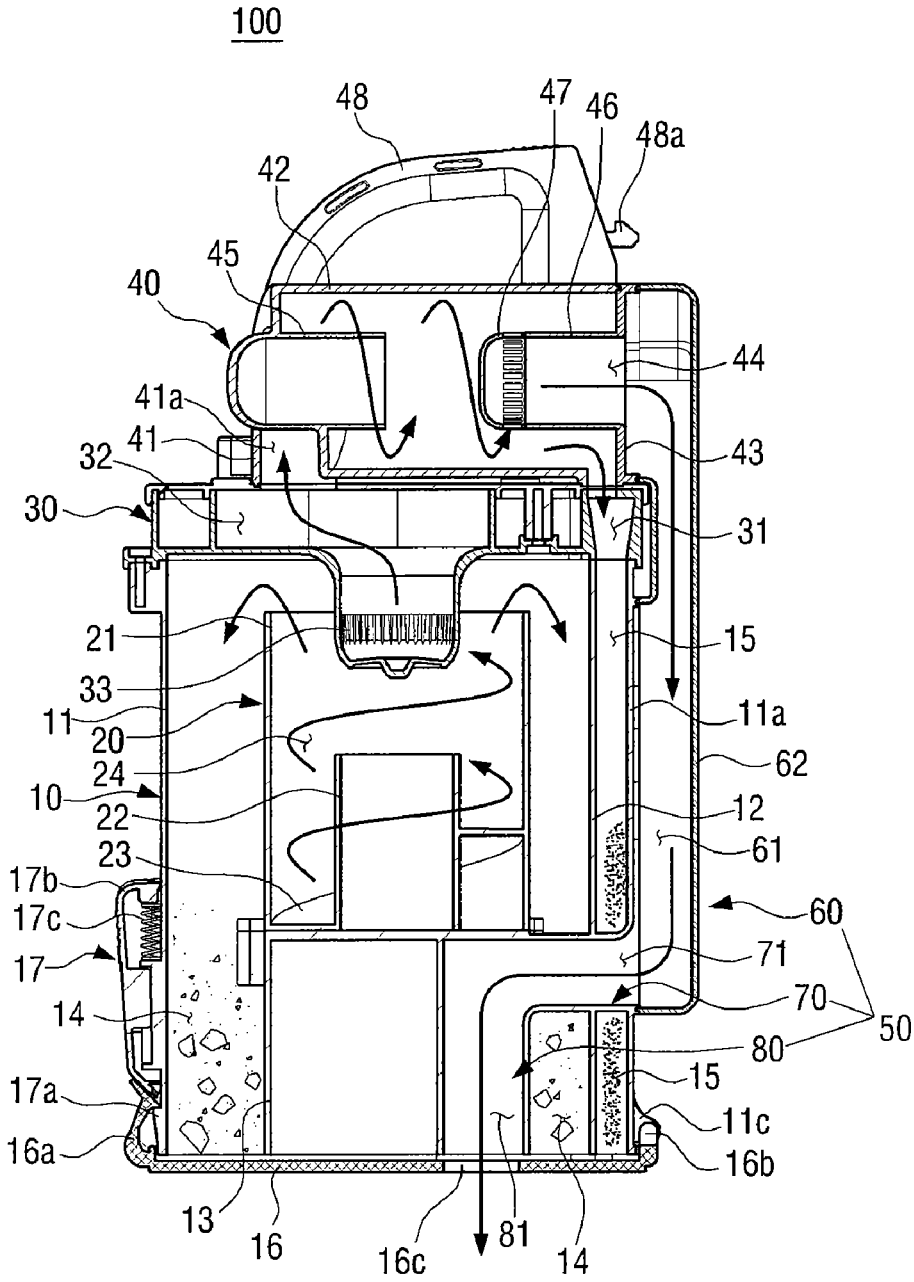
FIG. 4 is a cross-sectional view illustrating the dust collecting apparatus for the vacuum cleaner of FIG. 1.
Figure 5:
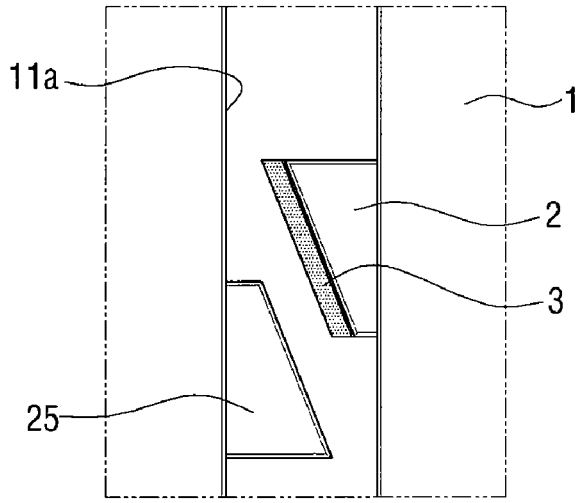
Figure 6:
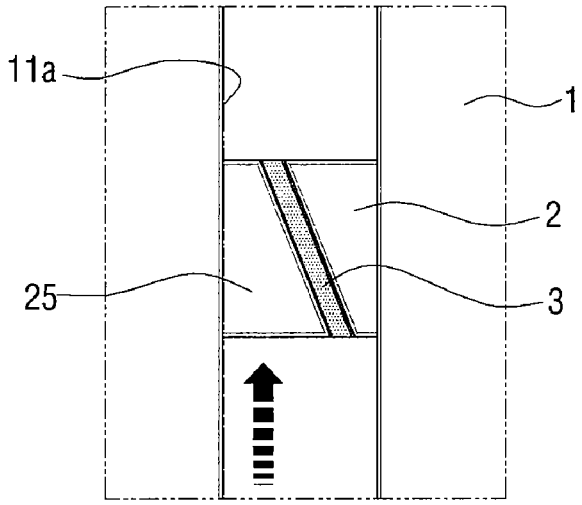

FIG. 1 is a front perspective view illustrating a dust collecting apparatus for a vacuum cleaner according to an exemplary embodiment of the present disclosure. FIG. 2 is a rear perspective view illustrating the dust collecting apparatus for the vacuum cleaner of FIG. 1. FIG. 3 is a partially exploded view illustrating the dust collecting apparatus for the vacuum cleaner of FIG. 1. FIG. 4 is a cross-sectional view illustrating the dust collecting apparatus for the vacuum cleaner of FIG. 1. FIGS. 5 and 6 illustrate the connection between an air inlet of the dust collecting apparatus for the vacuum cleaner of FIG. 1 and a connection port of a cleaner body, in which FIG. 5 illustrates the air inlet before being connected to the connection port and FIG. 6 illustrates the air inlet connected to the connection port.

Referring to FIGS. 1 to 4, a dust collecting apparatus 100 for a vacuum cleaner according to an exemplary embodiment of the present disclosure may include a dust collecting unit 10, a primary dust separating unit 20, a connection unit 30, a secondary dust separating unit 40, and an air discharge guide duct 50.

The dust collecting unit 10 has a cross section of approximately D shape, and includes an external casing 11 that is vertically opened, and a partition 12 that has a rectangular form and is disposed vertically to divide inner space of the external casing 11. As illustrated in FIGS. 3 and 4, the partition 12 is disposed close to a rear surface 11*a* of the dust collecting unit 10 so as to be parallel to the rear surface 11*a*, so the inner space of the dust collecting unit 10 may be divided into a first dust collecting chamber 14 and a second dust collecting chamber 15. The first dust collecting chamber 14 collects dust that is initially separated by the primary dust separating unit 20, and the second dust collecting chamber 15 collects dust that is subsequently separated by the secondary dust separating unit 40.

A lower cover 16 is disposed under the dust collecting unit 10 to open or close the dust collecting unit 10. As illustrated in FIGS. 2 and 3, a rotation shaft member 16*b* is formed at a rear end of the lower cover 16 so as to be rotatably connected to a pair of rotation supporting members 11*c* that is formed at a lower end of the rear surface 11*a* of the dust collecting unit 10. As illustrated in FIGS. 1 and 4, a hooking member 16*a* is formed at a front end of the lower cover 16 so as to be locked with or released from a locking unit 17 that is formed at front lower end of the external casing 11.

The locking unit 17 includes a hooking protrusion 17*a*, a pressing member 17*b*, and a return spring 17*c*. When the hooking member 16*a* of the lower cover 16 is hooked into the hooking protrusion 17*a* of the locking unit 17, the lower end of the dust collecting unit 10 is closed by the lower cover 16. If a user presses the pressing member 17*b* of the locking unit 17, the hooking member 16*a* separates from the hooking protrusion 17*a*, so the lower end of the dust collecting unit 10 is opened. The return spring 17*c* at the locking unit 17 allows the pressed pressing member 17*b* to automatically return to its original position.

As described above, since the lower cover 16 is provided at the lower end of the dust collecting unit 10, the user may open the lower cover 16 and dump dust collected in the first and second dust collecting chamber 14 and 15 conveniently.

In addition, as illustrated in FIGS. 2 and 4, an air outlet 16*c* penetrates the approximate center of the lower cover 16. The air outlet 16*c* externally discharges air cleaned by the dust collecting apparatus 100, and the air is drawn-in by a suction motor (not shown) that is installed under the dust collecting apparatus 100 so as to provide a suction force.

Since the dust collecting apparatus 100 according to this exemplary embodiment of the present disclosure has the air outlet 16*c* at the lower end thereof, an air path between the suction motor and the air outlet 16*c* may be shortened, thereby reducing the loss by the air path.

As illustrated in FIGS. 2 and 3, an air inlet 25 protrudes from the rear surface 11*a* of the external casing 11 of the dust collecting unit 10 so as to be in fluid communication with a primary dust separating chamber 24 in the primary dust separating unit 20. The end of the air inlet 25 is inclined with respect to the rear surface 11*a* of the external casing 11. Detailed description of the air inlet 25 is given below with reference to FIGS. 5 and 6.

The dust collecting apparatus 100 according to the exemplary embodiment of the present disclosure can be detachably mounted on a cleaner body 1 of the vacuum cleaner. When the dust collecting apparatus 100 is mounted on the cleaner body 1, the dust collecting apparatus 100 is raised at a predetermined height by an elevating means (not shown) of the cleaner body 1 as illustrated in FIG. 6, so the air inlet 25 on the rear surface 11*a* of the dust collecting apparatus is in close connection with a connection port 2 formed on the cleaner body 1. The connection port 2 guides drawn-in air to the air inlet 25 of the dust collecting apparatus, and has the shape corresponding to the shape of the air inlet 25. A sealing member 3 formed of an elastic material is formed at the end of the connection port 2.

The ends of the air inlet 25 of the dust collecting apparatus 10 are inclined and the ends of the connection port 2 of the cleaner body 1 are correspondingly declined. In this manner, when the dust collecting apparatus 10 is mounted on the cleaner body 1, an airtight connection between the air inlet 25 and the connection port 2 can be guaranteed, and the sealing member 3 can be prevented from being abnormally pushed by the air inlet 25.

As illustrated in FIGS. 3 and 4, the primary dust separating unit 20 is disposed in the center of the first dust collecting chamber 14 of the dust collecting unit 10. The primary dust separating unit 20 is detachably mounted on a mounting stage 13 (see FIG. 4) formed on the lower side of the first dust collecting chamber 14 through screw connection.

The primary dust separating unit 20 includes an external casing 21 that is opened at the upper portion and has a cylindrical shape, and a central pipe 22 that is formed at the center of the external casing 21 and has a cylindrical shape. By the external casing 21 and the central pipe 22, the primary dust separating chamber 24 is formed in the primary dust separating unit 20 so as to primarily separate dust from air drawn in the dust collecting apparatus 100 using the centrifugal force. A spiral guide 23 is formed on central pipe 22 to form a spiral air current in the dust separating chamber 24.

Air enters the primary dust separating chamber 24 from the lower portion of the first dust separating unit 20 through the air inlet 25 and moves upwards spirally using the central pipe 22 and the spiral guide 23. During this process, dust is separated from the air by the centrifugal force and is collected in the first dust collecting chamber 14 of the dust collecting unit 10 through the opened upper portion of the primary dust separation unit 20.

As illustrated in FIGS. 3 and 4, the connection unit 30 is disposed between the dust collecting unit 10 and the secondary dust separating unit 40. The connection unit 30 is coupled with the dust collecting unit 10 through screw connection, and is coupled with the secondary dust separating unit 40 through screw connection. Therefore, the dust collecting unit 10, the connection unit 30, and the secondary dust separating unit 40 can be separated if necessary.

The connection unit 30 has approximately a "D" shape corresponding to the external casing 11 of the dust collecting unit 10. A pair of dust guide channels 31 are formed at the rear end of the connection unit 30 to vertically penetrate the connection unit 30. The pair of dust guide channels 31 guide dust separated by the secondary dust separating unit 40 to the second dust collecting chamber 15 of the dust collecting unit 10. A guide path 32 is formed at the connection unit 30 to be in fluid communication with the primary dust separating chamber 24 downwards and to be in fluid communication with a secondary dust separating chamber 42 upwards. A first grill member 33 is formed at a lower surface of the connection unit 30 so as to filter large dust remaining in the air discharged from the primary dust separating chamber 24 to the guide passage 32.

The secondary dust separating unit 40 is mounted on the connection unit 30 to secondarily separate dust from drawn-in air using the centrifugal force. The secondary dust separating unit 40 includes a diverging member 41 that is in fluid communication with the guide path 32 of the connection unit 30, and a pair of secondary separating chambers 42 that receive air diverged by the diverging member 41 and secondarily separate dust from the air.

Referring to FIGS. 1 and 4, the diverging member 41 is disposed between the pair of secondary separating chambers 42, and has a pair of air holes 41*a* that are disposed in parallel. First ends of the pair of air holes 41*a* are in fluid communication with the guide path 32 of the connection unit 30, and second ends of the pair of air holes 41*a* are in fluid communication with the corresponding secondary separating chambers 42. Air discharged from the primary dust separating chamber 24 passes through the guide path 32 of the connection unit 30 and enters the pair of secondary separating chambers 42 through the pair of air holes 41*a*.

Referring to FIGS. 3 and 4, each of the secondary separating chambers 42 has a cylindrical shape, and includes a central pipe 45 upstream and a central pipe 46 downstream. Air enters the secondary separating chambers 42 through the air holes 41*a*, forms a spiral air current with the assistance of the central pipe 45 and the central pipe 46, so dust can be separated from the air by the centrifugal force. The dust is collected in the second dust collecting chamber 15 of the dust collecting unit 10 through the dust guide channels 31 of the connection unit 30 that is in fluid communication with the downstream of the secondary dust separating chambers 42.

A second grill member 47 is attached to a front end of the central pipe 46 so as to filter comparatively large dust remaining in air discharged from the secondary separating chambers 42. The air passes through the second grill member 47, and is discharged from the secondary dust separating unit 40 through a discharge hole 44 at the downstream end of the central pipe 46.

A handle 48 is disposed on the secondary separating unit 40. The user may easily carry the dust collecting apparatus 100 using the handle 48. A hook 48*a* is disposed on one side of the handle 48 so as to be hooked on an eye (not shown) on the cleaner body 1 so that the dust collecting apparatus 100 can be locked in the cleaner body 1. A separation button 48*b* is disposed on an upper side of the handle 48 so as to separate the hook 48*a* from the eye.

Referring to FIGS. 2 to 4, the air discharge guide duct 50 guides the air discharged from the secondary dust separating chambers 42 to the air outlet 16*c* formed at the lower cover 16. The air discharge guide duct 50 includes a first duct 60, a second duct 70, and a third duct 80.

The first duct 60 includes a duct forming member 62. As illustrated in FIG. 3, the duct forming member 62 has a comparatively small thickness (t) and has the shape such as a fan or a hand mirror, which includes a body portion 62*a* of an approximately pentagonal shape and a convergent portion 62*b* that extends from a lower end of the body portion 62*a*.

A lower portion of the body portion 62*a* and the convergent portion 62*b* are coupled with a first mounting groove 11*b* (see FIG. 3) formed on the rear surface 11*a* of the dust collecting unit 10 through airtight connection. An upper portion of the body portion 62*a* is coupled with a second mounting groove 43*a* (see FIG. 3) formed on a rear surface 43 of the secondary dust separating unit 40 through airtight connection. A guide channel 61 of the first duct 60 is formed by an inner surface of the duct forming member 62, the rear surface 11*a* of the dust collecting unit 10, and the rear surface 43 of the secondary dust separating unit 40.

Since the first duct 60 is formed by the duct forming member 62 that is coupled with the external surface of the dust collecting apparatus 100, reduction of space for collecting dust that may be caused when the first duct 60 is formed in the dust collecting apparatus 100 can be prevented. In addition, even though the first duct 60 is formed outside the dust collecting apparatus 100, space occupied by the first duct 60 is small since the duct forming member 62 has a comparatively thin thickness (t).

The second duct 70 horizontally extends from the rear surface 11*a* of the dust collecting unit 10 until the inside of the first dust collecting chamber 14 as illustrated in FIG. 4. A second guide channel 71 is formed in the second duct 70 so as to be in fluid communication with the first guide channel 61 of the first duct 60.

The third duct 80 is vertically disposed in the first dust collecting chamber 14 so as to connect the second duct 70 with the air outlet 16*c* on the lower cover 16 as illustrated in FIG. 4. A third guide channel 81 is formed in the third duct 80 so as to be in fluid communication with the second guide channel 71 of the second duct 70.

The first duct 60 is formed by the duct forming member 62 that is coupled with the rear surface of the dust collecting apparatus 100, and the second duct 70 and the third duct 80 are formed in the dust collecting apparatus 100, so the air discharge guide duct 50 may be integrally formed with the dust collecting apparatus 100. Accordingly, since the cleaner body 1 on which the dust collecting apparatus 100 is mounted does not need to have a separate component for guiding air discharged from the dust collecting apparatus 100 to the suction motor, the structure of the cleaner body 1 can be more simplified.

The operation of the dust collecting apparatus 100 according to the exemplary embodiment of the present disclosure is described with reference to FIG. 4.

Dust-laden air is drawn into the dust collecting apparatus 100 from the surface being cleaned and enters the primary dust separating chamber 24 in the dust collecting unit 10 through the air inlet 25 (see FIG. 2) on the rear surface 11*a* of the dust collecting unit 10. While the air spins and goes up in the first dust separating chamber 24, dust is primarily separated from the air and is collected in the first dust collecting chamber 14 through the opened upper side of the primary dust separating chamber 24.

Subsequently, the air passes through the first grill member 33 at the upper portion of the primary dust separating chamber 24, so comparatively large dust remaining in the air can be filtered. The air passes through the guide path 32 at the connection unit 30, and enters the pair of secondary dust separating chambers 42 of the secondary dust separating unit 40 through the diverging member 41.

Subsequently, the air spins and moves forward in the secondary dust separating chambers 42, so dust is secondarily separated from the air using the centrifugal force and is collected in the second dust collecting chamber 15 that is in fluid communication with the downstream of the secondary dust separating chambers 42. The air enters the central pipe 46 having the second grill member 47, so comparatively large dust remaining in the air can be filtered by the second grill member 47.

Later, the air enters the first duct 60 of the air discharge guide duct 50 through the discharge hole 44 at the downstream of the central pipe 46. The air is guided downwards along the rear surface 11*a* of the dust collecting unit 10 by the first duct 60, is guided into the dust collecting unit 10 by the second duct 70 that is horizontally disposed, is guided downwards by the third duct 80, and is lastly discharged to the suction motor disposed under the dust collecting apparatus 100 through the air outlet 16*c* at the lower cover 16.

As can be appreciated from the above description of the dust collecting apparatus 100, the cleaned air is discharged to the suction motor through the lower end of the dust collecting apparatus 100, so an air path between the dust collecting apparatus 100 and the suction motor can be shortened, thereby reducing the loss by the air path.

In addition, since the first duct 60 of the air discharge guide duct 50 is formed at the external surface of the dust collecting apparatus 100, invasion of dust collecting space by the air discharge guide duct 50 may be reduced. Furthermore, even though the first duct 60 is formed outside the dust collecting apparatus 100, space occupied by the first duct 60 may be reduced since the duct forming member 62 is comparatively thin.

In addition, since the air discharge guide duct 50 is integrally faulted with the dust collecting apparatus 100, the cleaner body in which the dust collecting apparatus 100 is installed does not need to have a separate component for guiding cleaned air to the suction motor. Accordingly, the structure of the cleaner body may be more simplified.

Since the lower cover 16 capable of being opened or closed is installed at the lower end of the dust collecting apparatus 100, the user may easily dump the dust collected in the dust collecting chambers 14 and 15.

Furthermore, the dust collecting unit 10, the primary dust separating unit 20, the connection unit 30, the secondary dust separating unit 40, and the duct forming member 62 can be separated from each other, so it is easy to disassemble and repair the dust collecting apparatus 100 if necessary.

Lastly, one end of the air inlet 25 of the dust collecting apparatus 100 is inclined, so when the dust collecting apparatus is mounted on the cleaner body 1, airtight connection between the air inlet 25 of the dust collecting apparatus and the connection port 2 of the cleaner body 1 can be guaranteed and the sealing member 3 can be prevented from being abnormally pushed by the air inlet 25.

While the invention has been shown and described with reference to certain embodiments thereof, it will be understood by those skilled in the art that various changes in form and details may be made therein without departing from the spirit and scope of the invention as defined by the appended claims.

What is claimed is:

1. A dust collecting apparatus for a vacuum cleaner, comprising:

a dust separating chamber separating dust from dust-laden air, the dust separating chamber comprises a primary dust separating chamber and at least one secondary dust separating chamber, the primary dust separating chamber and the at least one secondary dust separating chamber being cyclone separating chambers;

a dust collecting chamber storing dust separated from the dust-laden air by the dust separating chamber; and an air discharge guide duct guiding the air discharged from the dust separating chamber to an air outlet at a lower end of the dust collecting apparatus, the primary dust separating chamber having a primary air spinning axis and the secondary dust separating chamber having a secondary air spinning axis, the secondary air spinning axis being vertically above the primary air spinning axis, wherein the air discharge guide duct comprises:

a first duct formed on a rear surface of the dust collecting apparatus so as to guide the air discharged from the dust separating chamber downwards;

a second duct being connected to the first duct and extending into the dust separating chamber; and a third duct formed in the dust separating chamber so as to connect the second duct with the air outlet.

2. The dust collecting apparatus according to claim 1, wherein the primary dust separating chamber is disposed in the dust collecting chamber, and a lower surface of the primary dust separating chamber is disposed higher than a lower surface of the dust collecting chamber.

3. The dust collecting apparatus according to claim 2, further comprising a grill member provided in the primary dust separating chamber and another grill member provided in the secondary dust separating chamber.

4. The dust collecting apparatus according to claim 1, further comprising an air inlet formed on the rear surface of the dust collecting apparatus.

5. The dust collecting apparatus according to claim 4, wherein one end of the air inlet is inclined.

6. The dust collecting apparatus according to claim 1, wherein the at least one secondary dust separating chamber comprises a plurality of secondary dust separating chambers that are arranged in parallel.

7. The dust collecting apparatus according to claim 6, wherein the dust collecting chamber and the primary dust separating chamber are separated from or coupled with the secondary dust separating chambers.

8. The dust collecting apparatus according to claim 6, further comprising a cover of the dust collecting chamber for selectively opening or closing the lower end of the dust collecting chamber.

9. The dust collecting apparatus according to claim 1, further comprising a handle disposed on the secondary dust separating chamber, the handle having a hook member to be locked with a cleaner body.

10. A dust collecting apparatus for a vacuum cleaner, comprising:

a dust collecting unit having an opened upper portion;

a primary dust separating unit formed in the dust collecting unit and comprising a primary dust separating chamber for primarily centrifugally separating dust from air drawn into the dust collecting apparatus;

a secondary dust separating unit disposed above the dust collecting unit and comprising at least one secondary dust separating chamber for secondarily centrifugally separating dust from air drawn into the dust collecting apparatus;

a connection unit disposed to connect the dust collecting unit and secondary dust separating unit; and an air discharge guide duct guiding the cleaned air discharged from the secondary dust separating unit to an air outlet at a lower end of the dust collecting apparatus, the primary dust separating chamber having a primary air spinning axis and the secondary dust separating chamber having a secondary air spinning axis, the secondary air spinning axis being vertically above the primary air spinning axis, wherein the air discharge guide duct comprises:

a first duct formed on a rear surface of the dust collecting unit along a longitudinal direction of the dust collecting unit;

a second duct penetrating the second dust collecting chamber and extending into the first dust collecting chamber; and a third duct extending to a bottom of the dust separating unit.

11. The dust collecting apparatus according to claim 10, wherein the dust collecting unit and the primary dust separating unit are separable from the connection unit.

12. The dust collecting apparatus according to claim 10, wherein the primary dust separating unit is spaced apart from a bottom of the dust collecting unit at a predetermined distance.

* * * * *